United States Patent [19]

Scheuchzer et al.

[11] 4,400,897

[45] Aug. 30, 1983

[54] METHOD AND RAILWAY TRAIN FOR DRAINING A RAILWAY TRACK

[75] Inventors: Fredy Scheuchzer, Lausanne; Fritz Bühler, Ecublens, both of Switzerland

[73] Assignee: Les Fils d'Auguste Scheuchzer S.A., Lausanne, Switzerland

[21] Appl. No.: 353,486

[22] Filed: Mar. 1, 1982

Related U.S. Application Data

[63] Continuation-in-part of Ser. No. 188,113, Sep. 17, 1980, Pat. No. 4,319,416.

[30] Foreign Application Priority Data

Nov. 8, 1979 [EP] European Pat. Off. ..... 79810147.3
Feb. 9, 1982 [EP] European Pat. Off. ..... 82200150.9

[51] Int. Cl.[3] ..... E01B 37/00
[52] U.S. Cl. ..... 37/104; 104/7 R
[58] Field of Search ..... 37/104, 105, 195; 104/2, 4–10, 12

[56] References Cited

U.S. PATENT DOCUMENTS

| | | | |
|---|---|---|---|
| 3,680,486 | 8/1972 | Plasser et al. | 104/12 X |
| 3,731,409 | 5/1973 | Schenkir et al. | 37/104 |
| 3,744,428 | 7/1973 | Plasser et al. | 104/12 |
| 4,108,076 | 8/1978 | Knape | 104/2 |
| 4,160,418 | 7/1979 | Theurer | 104/2 |
| 4,207,820 | 6/1980 | Liun-Sain | 104/2 |
| 4,211,170 | 7/1980 | Theurer | 104/2 |
| 4,236,452 | 12/1980 | Theurer et al. | 104/2 |
| 4,249,467 | 2/1981 | Theurer et al. | 104/2 X |
| 4,284,009 | 8/1981 | Theurer et al. | 37/104 X |
| 4,319,416 | 3/1982 | Scheuchzer | 37/104 |

FOREIGN PATENT DOCUMENTS

| | | | |
|---|---|---|---|
| 1032298 | 6/1958 | Fed. Rep. of Germany | 37/104 |
| 58066 | 4/1970 | German Democratic Rep. | 37/104 |
| 1169721 | 11/1969 | United Kingdom | 37/104 |

*Primary Examiner*—E. H. Eickholt
*Attorney, Agent, or Firm*—Robert E. Burns; Emmanuel J. Lobato; Bruce L. Adams

[57] ABSTRACT

A method for the improvement and drainage of a railway track employs a train comprising a working frame-car to carry out the method whereby it is made possible to dismantle and reassemble the track together with its infrastructure. The old track spans are removed, ballast and earth are excavated from the track and replaced by a layer of sand and by new ballast which are distributed, levelled and compacted mechanically. All these operations are taking place in succession through and within the empty frame of said frame-car as the latter is stationary bridging the working site. Two travelling gantries are provided on the train and equipped both with a lifting device for a track span and a lifting and tipping device for buckets. The working car is also equipped with means for excavating, digging, levelling and compacting.

11 Claims, 13 Drawing Figures

METHOD AND RAILWAY TRAIN FOR DRAINING A RAILWAY TRACK

REFERENCE TO PRIOR APPLICATION

This application is a continuation-in-part of application Ser. No. 188,113 filed Sept. 17, 1980 now U.S. Pat. No. 4,319,416.

FIELD OF INVENTION

The invention relates to a method for improving the drainage of a railway track and a railway train for carrying out the method.

In certain terrains where it is difficult for water to drain, the stability of a railway track may be jeopardized by flooding. Tracks of this type must be drained by a permeable bed.

THE PRIOR ART

A known method of draining a railway track comprises the excavation of the ballast and the earth of the road bed or the infrastructure to a depth which depends on the terrain and replacement of the materials excavated by a compacted layer of sand.

For correct distribution and compacting of the layer of sand, it is necessary to dismantle the old track completely.

Various trains are known comprising machines for the excavation of the ballast, its loading and its discharge, for example as described in Swiss Pat. Nos. 597.428 and 609.622, which can be used under the circumstances. An installation is also known for renewing the track, namely as described in Swiss Pat. No. 549.692. The train described by this latter patent comprises a continuous track for gantries provided with gear for lifting lengths of track and a truck composed of an empty frame through which it is possible to pass the track spans.

This installation is not suitable for improving drainage of the track, nor is the renewal train described in Swiss Pat. No. 583.822. The design of this train makes it impossible to include operations for putting the layer of sand in place, which must be effected before the ballast is put in place.

It is apparent from this state of the art that the distribution and compacting of the sand and ballast are still carried out manually and by means of appliances which are illsuited to this type of work. This method of working requires a high number of workers at the site and the output per hour is low. Furthermore, the present system of working requires the storage of the old and new sleepers on the site. Due to a lack of space, the sleepers are frequently stored in the area of the bed whereof the drainage is to be improved and consequently this part must be treated before or after improving the drainage of the remainder of the track.

At present, the work is carried out in the following manner by the following stages:

- previous unloading of new sleepers onto the bed;
- manual dismantling of the old sleepers and storage at the side of the track, the old sleepers being removed from the site;
- excavation and loading of the ballast by means of machines;
- assembly of a working track which rests on the bed through the intermediary of studs;

- unloading of the trucks and manual distribution of the sand;
- manual dismantling of the working track and of the support studs embedded in the sand;
- compacting of the sand;
- unloading and distribution of the ballast;
- assembly of the new sleepers either manually or by means of lifting gear;
- unloading and distribution of the complementary ballast; and
- assembly of the new track.

SUMMARY OF THE INVENTION

The present invention intends to remedy this state of affairs and provide a novel solution to the problem of improving the drainage of a railway track. It is therefore the primary object of the present invention to rationalize the drainage works while reducing the time required therefor, and the cost of the means implemented as well as the number of train and car shuttles.

According to a first aspect of the present invention there is provided a method for improving the drainage of a railway track comprising the steps of excavating ballast and earth from the infrastructure of the track, the so-called platform, and then distributing a layer of sand and new ballast at the centre of the track, levelling and compacting the bed, sand and ballast mechanically through the empty frame of a working frame-car specifically equipped for this purpose, and reassembling the railway track.

Preferably this method is completed such that it comprises the following operations:

(a) removing the old spans,
(b) excavating the ballast and the earth from the infrastructure,
(c) replacing the excavated earth with a sand layer constituting the new roadbed foundation or platform,
(d) levelling and compacting this foundation,
(e) restoring the new ballast,
(f) levelling and compacting the new ballast,
(g) laying the new track.

At least all the operations (a) to (f) taking place in succession through and within the empty frame of a working frame-car as the latter is stationary above the working site and bearing with its rear wheels on the new track and with its front wheels on the old track.

According to a second aspect of the present invention there is provided a railway train for use in the completed method according to the first aspect of the invention comprising a working car consisting of a frame-car with an empty frame of a length in excess of the length of one track span, said car having two trucks rolling the rear one on the new track and the front one on the old track and, ahead of said frame-car, a set of carriages provided with equipments for loading the excavation and, at the rear of said frame-car, other cars for transporting the spans, the sand and the ballast, guide rails installed on said transport cars and said frame-car, two gantries adapted to roll on said guide rails installed on said transport cars and said frame-car, said gantries supporting hoisting means for lifting a span and means for handling buckets for transporting the sand and ballast, and a rolling truck also movable on said guide rails ahead of said two gantries and from which at least one vertically adjustable excavator is suspended, said excavator covering either the full width of the excavation or only a reduced width, and being movable laterally or adapted to pivot for excavating the ballast, a swivel-mounted digging device mounted at the rear of said excavator, and consisting preferably of an endless chain associated with helical transverse fins, said digging device being provided with hydraulic cylinders for moving same in a vertical plane and in a longitudinal plane, respectively, said digging device being so designed that it can dig to a depth greater than the excavation and covers the full excavation width.

The advantages obtained by this invention are above all the speed at which the work advances, which is of prime importance for a railway track, a considerable reduction of workers on the site, greater regularity and better quality of the work carried out owing to the fact that the bed below the working truck is free of any obstacles, mechanical levelling of the track, and the fact that distribution, levelling and compacting of the sand and ballast may take place under optimum conditions.

The advantages deriving from the completed method and the train are an improved efficiency, the use of a single set of carriages bearing with its rear truck on the new track and with its front truck on the old track, the reduction of the working area to the length of one track span plus a storage area. Moreover, the machine of the present invention operates step by step, without any break, when carrying out the complete sequence of operations necessary for draining the railway track with the possibility of laying new spans or old spans if they can be regenerated or old spans consisting of old rails and new sleepers or ties, by using gantries designed for this purpose. The excavation may be conducted in two steps: firstly the ballast which if desired and possible may be recovered, then the earth of the roadbed foundation and the gravel may be discharged just behind the excavator.

Another advantage characterizing this track draining train is the rational use of the digging device consisting preferably of a blade adapted to perform two functions, namely either grading or digging, by setting said blade for a greater depth of cut than the endless chain in order to free the material to be excavated.

In addition, when relatively bulky stones or rocks have to be excavated,, the levelling blade, provided with hydraulic cylinders, may perform movements similar to those of a power shovel bucket. To improve the blade penetration, the latter may consist for example of three units each responsive to separate control means. On the other hand, large stones or rocks which cannot be transported by the endless chain are pushed off the roadbed foundation with the assistance of the levelling blade. For this purpose, these large stones are wedged between the blade, the endless chain and the helical fins, and thus moved laterally outwards until the stones are brought onto the benches. Moreover, it may be pointed out since that all these steps and more particularly the excavation and levelling ones, are accomplished directly from the frame-car standing on the track, the regularity of the ground-work operations is warranted by the fact that the digging takes place in a direction parallel to the track, at the selected depth, whereby the ground surface is perfectly smooth after the removal of the old roadway, this constituting a good preparation before building the new roadway.

The present invention will now be described by way of examples with reference to the accompanying drawings.

THE DRAWINGS

DESCRIPTION OF THE PREFERRED EMBODIMENTS

Figure 1:
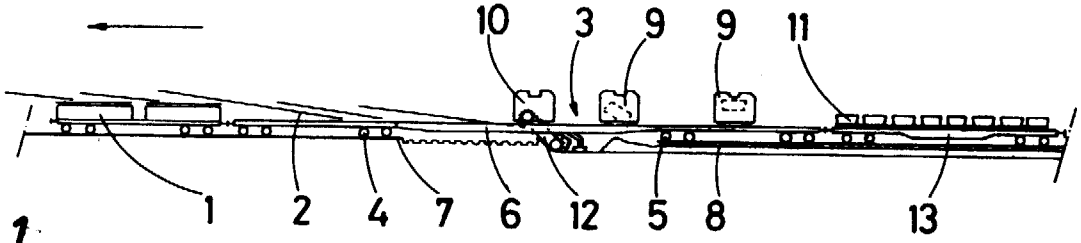
FIG. 1 is a diagrammatic side elevational view showing on a reduced scale a complete railway track drainage train according to the present invention.
Figure 3:
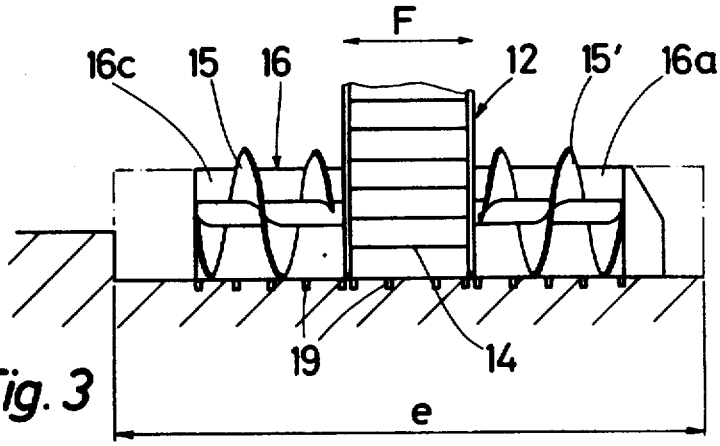
FIG. 3 is a diagrammatic cross-sectional view of the excavator provided with lateral spiral or helical fins.

The railway track draining and renewing train according to the present invention, which is shown partially in FIG. 1, is driven by a locomotive (not shown) and comprises in its front portion a plurality of cars 1 for loading the excavation conveyed by means of an assembly of telescopic endless belts 2. A working car 3 rolling on a pair of trucks 4,5 comprises an empty frame 6 having a length L greater than that 1 of a track span 1. This empty frame 6 is provided with guide rails or races having corresponding extension on the rear cars and adapted to carry the various gantries, of which two (9) are equipped with means for hoisting a track span, other means for controlling a plurality of buckets 11 for transporting sand and ballast; said gantries and said means for lifting, transporting and tipping the buckets as well as the guide rails for the gantries and for the ramming device which will be mentioned below, can be similar as shown on FIGS. 12 and 13, described later. Ahead of the two gantries 9, a truck 10 is also rolling on the guide rails and from which an excavator 12 is suspended; basically, this excavator 12 may be similar to the one disclosed in the Swiss Pat. No. 583,822 and may be either designed to cover the full excavation width e or, as shown in FIG. 3, for operating on a reduced width; this excavator 12 is movable laterally in the direction of the arrow F. Furthermore, the train comprises rear cars 13 for transporting not only the buckets loaded with sand and new ballast but also the new spans or the new rails.

Figure 2:
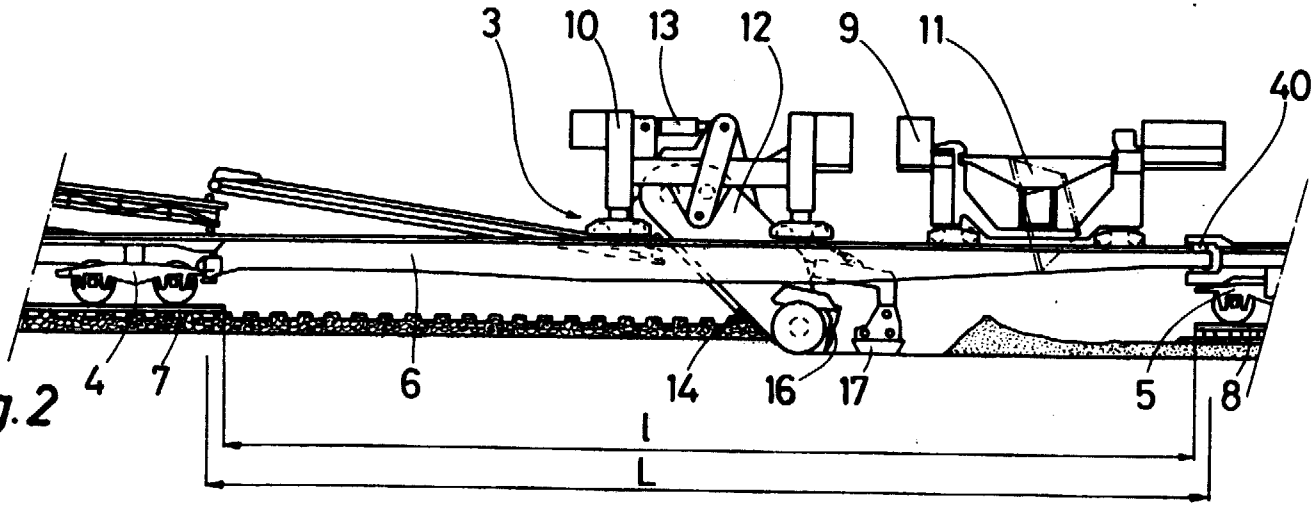
FIG. 2 illustrates on a considerably larger scale the frame car with its equipment.

Referring to FIG. 2 illustrating more in detail the working car 3, it will be seen that the excavator 12 supported by truck 10 is provided with a hydraulic cylinder 13 for adjusting its vertically position, other cylinders (not shown) permitting its transverse and longitudinal adjustment. This excavator 12 comprises an endless excavating chain 14 with two lateral helical fins 15,15' (FIG. 3), a digging device 16 consisting of a blade to be described more in detail hereinafter, and at the rear of the digging blade 16, a rammer or tamper 17 also controlled by means of hydraulic cylinders. Moreover, this excavator 12 could be mounted for swivel movement about a vertical axis.

To warrant a perfect digging depth and a perfect slant of the roadway or the roadbed foundation, the frame of the working car 3 is held in a horizontal or inclined position, as a function of the slant of the roadway or the roadbed bottom, by means of penduli. To maintain the longitudinal profile, that is, to permit at any time the orientation of the frame 6 parallel to the roadbed bottom, respectively to the terrace or bench, the frame 6 is mounted on the rear truck 5 by means of a hydraulic cylinder 40 permitting its vertical adjustment.

The endless excavating chain 14 with its helical fins 15,15' is adapted to excavate the bench down to a depth of, say, 90 centimeters and over a width of about 5 meters. The endless chain delivers the excavation to an endless telescopic conveyor belt 2 mounted on the front car 1 and adapted to connect the chain 15 to cars disposed at the front of the train and adapted to carry away the waste.

In this first form of embodiment the digging blade 16 is mounted directly to the excavator 12 whereby, as will be described presently, a cooperation is obtained between the blade and the excavator for removing large stones. Moreover, in this specific form of embodiment the excavator 12 is coupled to the rammer 17.

Figure 5:
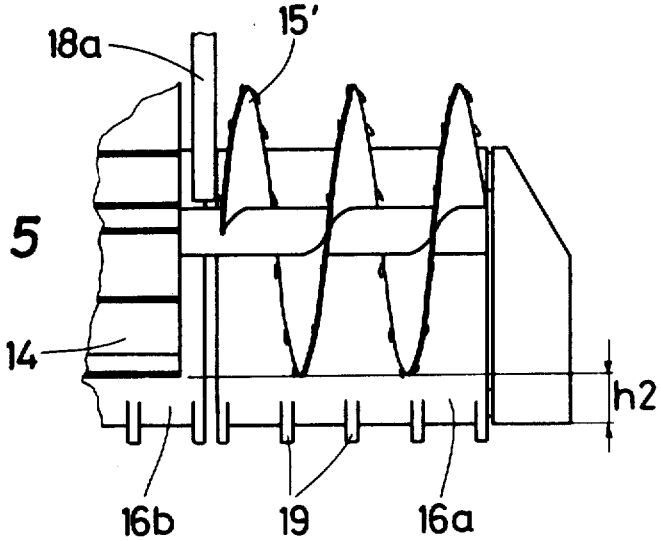
FIG. 5 is a detail view of a spiral or helical fin with the digging device consisting of a blade shown in its lower position with respect to the excavator level.
Figure 6:
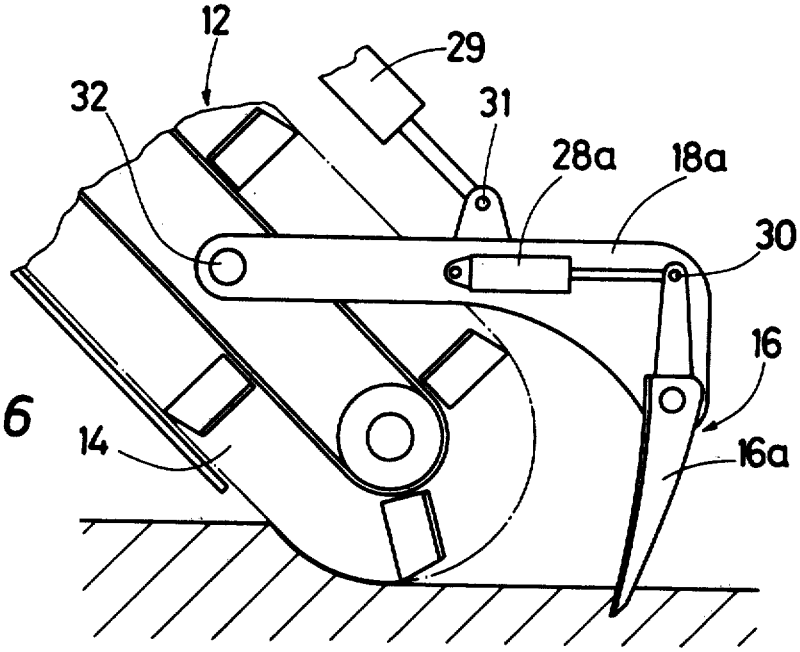
FIG. 6 illustrates in side elevational view the excavator and the digging blade extended in its operating position.
Figure 7:
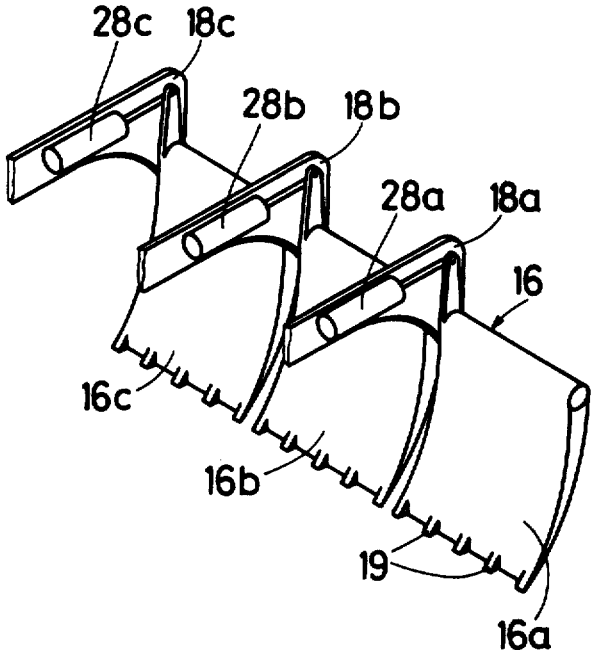
FIG. 7 is a diagrammatic perspective view of the blade and its separate control means.

To improve the penetration of the digging blade having a length of, say, 2.6 m, this blade consists of three lateral sections **16*a*,16*b*,16*c* (FIGS. 3 to 7) actuated separately by corresponding hydraulic cylinders 28*a*,28*b*,28*c* to which they are pivotally mounted by means of a pivot pin 30, said cylinders being mounted in turn to arms 18*a*,18*b*,18*c* pivotally mounted by means of a main pivot pin 32 to the excavator 12; these arms 18*a*,18*b*,18*c* are actuated separately by hydraulic cylinders 29 pivotally mounted at 31, FIG. 6 showing only one of these cylinders. With these various control and pivot means it is possible to impart separately or simultaneously to each segment 16*a*,16*b*,16*c* movements similar to those of a power-shovel bucket, whereby large stones, rocks or ballast fragments can be excavated efficiently. The stones and the like thus excavated by the blade are subsequently moved by the helical fins 15,15' towards the central chain 14 of the excavator and the largest stones which cannot be transported by the chain are expelled outside the roadway with the assistance of blades 16*a*,16*b*,16*c*. To this end, the largest stones will be wedged between the blade 16, the chain 14 and the helical fins 15**, the complete assembly being moved laterally until the stones or rocks can be deposited upon the benches.

Figure 4:
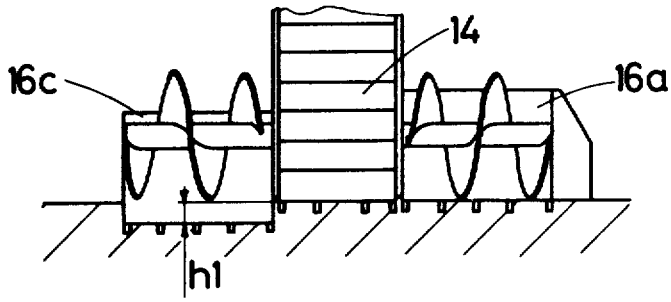
FIG. 4 is a view similar to FIG. 3 but showing one blade in a lower working position than the other blades.

Of course, the blade 16 could consist of a single section, or two or more than three sections, but obviously a blade divided into several sections adapted to be adjusted separately affords an improved ballast removing action and a more flexible handling than a single, wide blade. As illustrated in FIG. 4, in case of need a single section **16*c* only may be lowered by a height h in relation to the level of the other sections 16*a*, 16*b* for removing a large stone located in front of this single section 16*c*, or alternatively, as illustrated in FIG. 5, both sections 16*a*,16*b*** could be lowered to the same depth in relation to the excavator level. If the blade comprises several lateral sections, it is also possible to contemplate the pivotal mounting of each section about a separate vertical axis.

To warrant a sufficient tear-up force, the excavator 12 is driven along the working car 3 with the assistance of winches mounted on the front and rear cars.

The gravel and ballast are levelled either by means of the blade 16 and helical fins 15 which transfer the excavation outwards, or by means of a blade swivel-mounted on the rammer suspension structure, as will be described presently.

In the specific form of embodiment illustrated in FIGS. 3 to 7 of the drawings, the lower portion of blade 16 is provided with teeth 19 in order better to tear off the ballast, however without any inconvenience when the blade is utilized for levelling the roadbed foundation on the bench, said teeth forming only shallow grooves without any detrimental consequence.

Figure 8:
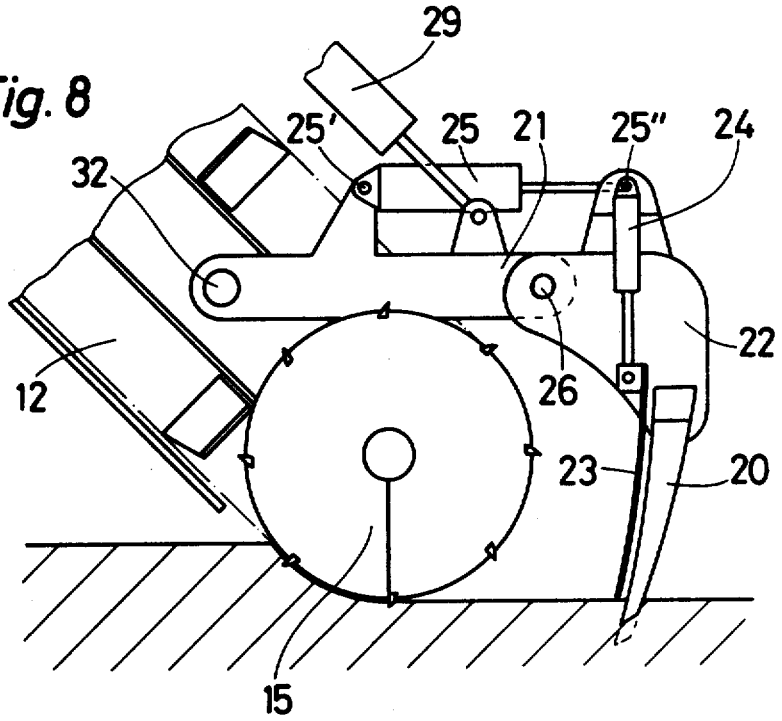
FIG. 8 illustrates in side elevational view a modified form of embodiment of the blade provided with a grubbing rake.
Figure 9:
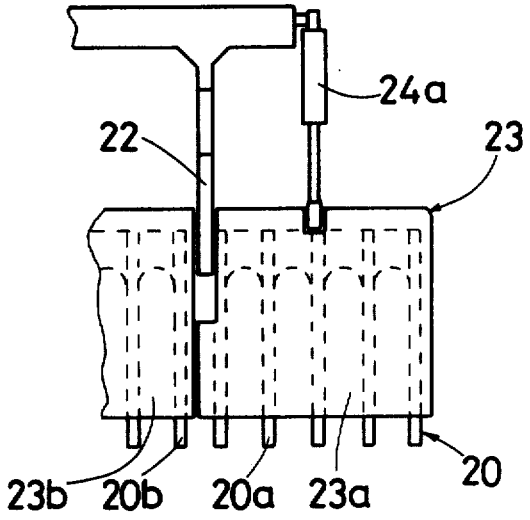
FIG. 9 is a fragmentary front view of the blade of FIG. 8.

According to a modified form of embodiment illustrated in FIGS. 8 and 9, the digging device comprises a grubbing rake 20 consisting of three lateral sections **20*a*,20*b*,20*c* adjustable in the longitudinal plane and depthwise, for further improving the excavation of the old ballast. Each section 20*a*,20*b*,20*c* of the grubbing rake is carried by an arm 22 pivoted at 26 to another arm 21 pivoted in turn at 32 to the excavator 12. The arm 21 can be tilted about the pivot pin 32 by means of a hydraulic cylinder 29, and the arm 22 is adapted to rotate about the pivot pin 26 under the control of a hydraulic cylinder 25 pivotally connected at one end through a pin 25' to arm 21 and at the other end through a pin 25'' to arm 22. Furthermore, this grubbing rake 20 operates in conjunction with a levelling blade 23 also consisting of three sections 23*a*,23*b*,23*c* and adjustable separately by means of a cylinder 24*a*, respectively, whereby these three sections can operate or not at the same level as the three sections 20*a*,20*b*,20*c*** of the grubbing rake.

Figure 10:
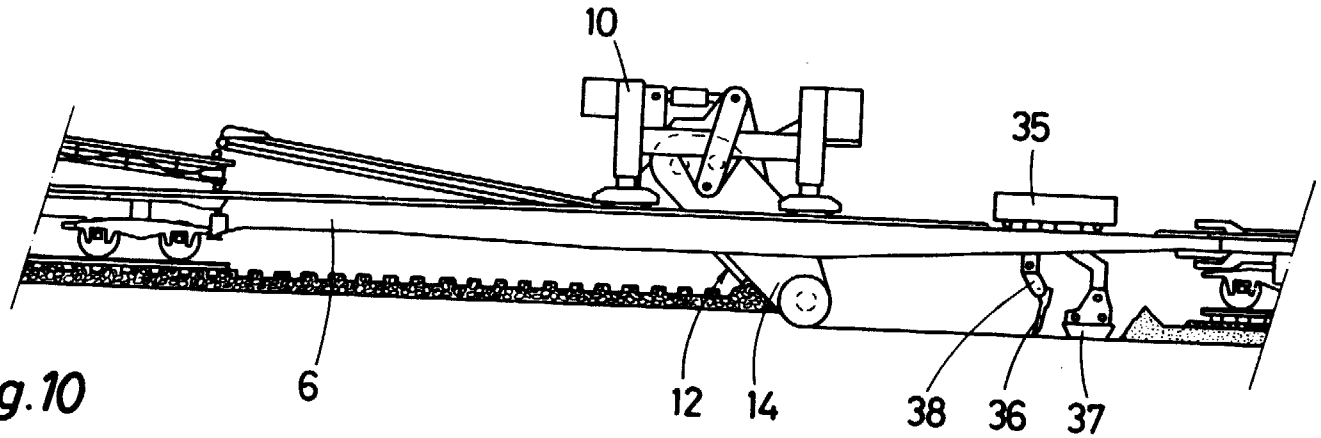
FIG. 10 is a diagrammatic general view of a modified form of embodiment of the frame car.

According to another modified form of embodiment, illustrated diagrammatically in FIG. 10, the excavator 12 comprises only the excavation chain 14 and helical fins 15,15' but, in contrast to the last-described form of embodiment, it is not combined with the digging and levelling blade or with a ramm. In this example, the digging blade 36 responsive to a set of hydraulic cylinders 38 shown only diagrammatically in FIG. 10 is mounted to a separate truck 35 rolling on the guide rails of the working car, behind the truck 10 supporting the excavator 12, and this separate truck 35 is provided with separate drive means so that it can be moved independently of the excavator 12. If desired, the rammer 37 may also be mounted to this truck 35.

The works, taking place in all cases within the empty frame, comprise the following sequence of operations:

removing the old spans by means of the gantries 9, excavating the old ballast and the old roadway earth, and transporting the material by means of the endless belt conveyors 2 to the cars 1 at the front of the train, levelling and compacting the roadbed foundation or bench, transporting and distributing the new gravel by means of the gantries; this operation may take place as soon as the first few meters of the roadbed foundation have been excavated and rammed, levelling the gravel by means of the levelling blade, and ramming, transporting and discharging the new ballast by means of the gantries, levelling and compacting the new ballast, laying the new spans or the old spans, or spans comprising old rails and new sleepers, by using the gantries, and advancing the drainage train.

Figure 11:
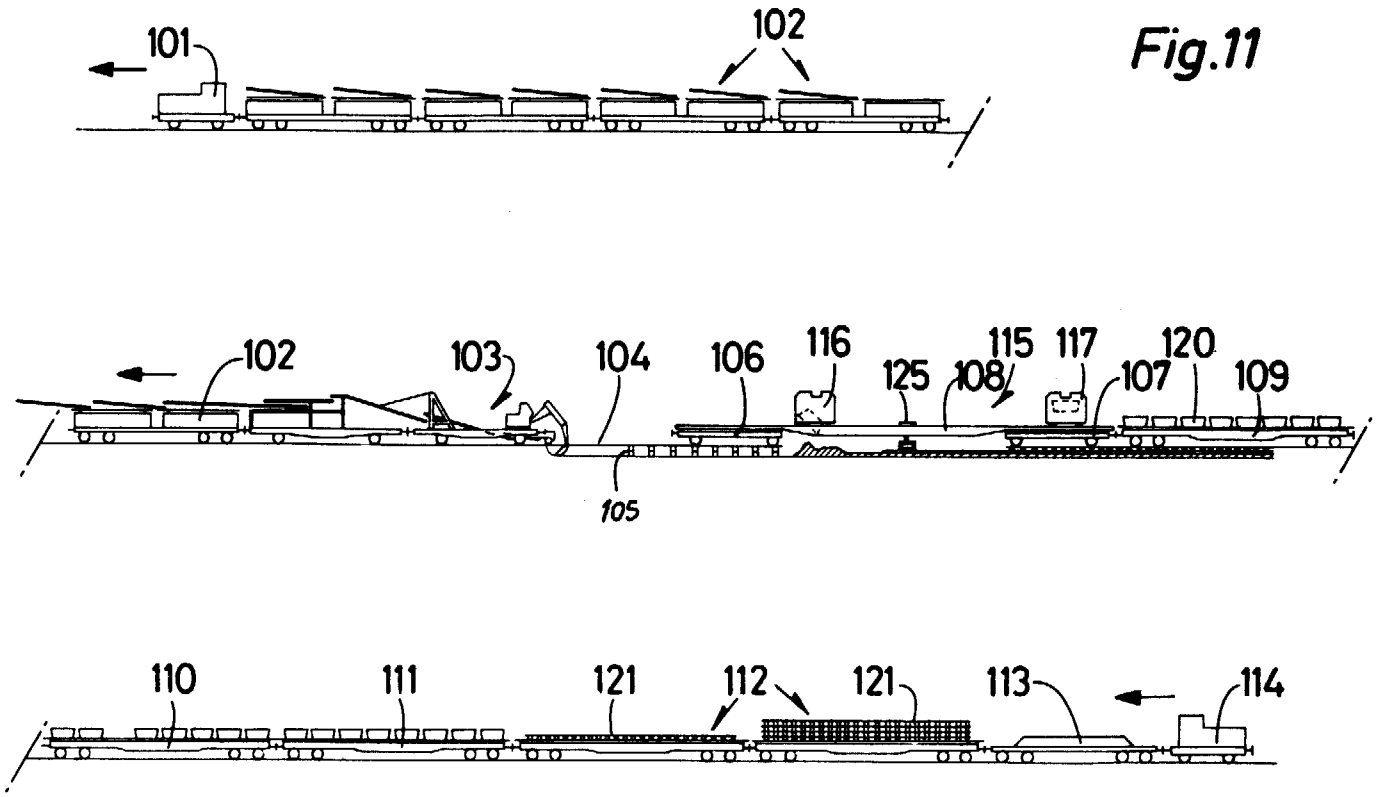
FIG. 11 is a diagrammatic general view of a train according to another embodiment.

The train shown diagrammatically in FIG. 11 concerns another embodiment and is composed of a first set of rail cars which comprises the engine 101, cars 102 for transporting excavated ballast as described in Swiss Pat. No. 609,622, and an excavation machine 103 as described in Swiss Pat. No. 597,428. This set of cars travels on a track, a so-called working track 104, provided with iron sleepers which can be easily dismantled. In order to compensate for the height of the ballast and of the roadbed foundation which have been excavated, the rails 104 are placed on studs 105 at the point where a front truck 106 of the working car 115 travels.

The second set of cars comprises the working car 115 composed of the trucks 106 and 107 and of an empty frame 108 provided with tracks extending onto the cars of the second set of cars. This second set of cars comprises cars 109 loaded with buckets of sand, cars 110 loaded with empty buckets, cars 111 loaded with ballast, cars 112 loaded with track spans, cars 113 loaded with complementary ballast and the engine 114.

Figure 12:
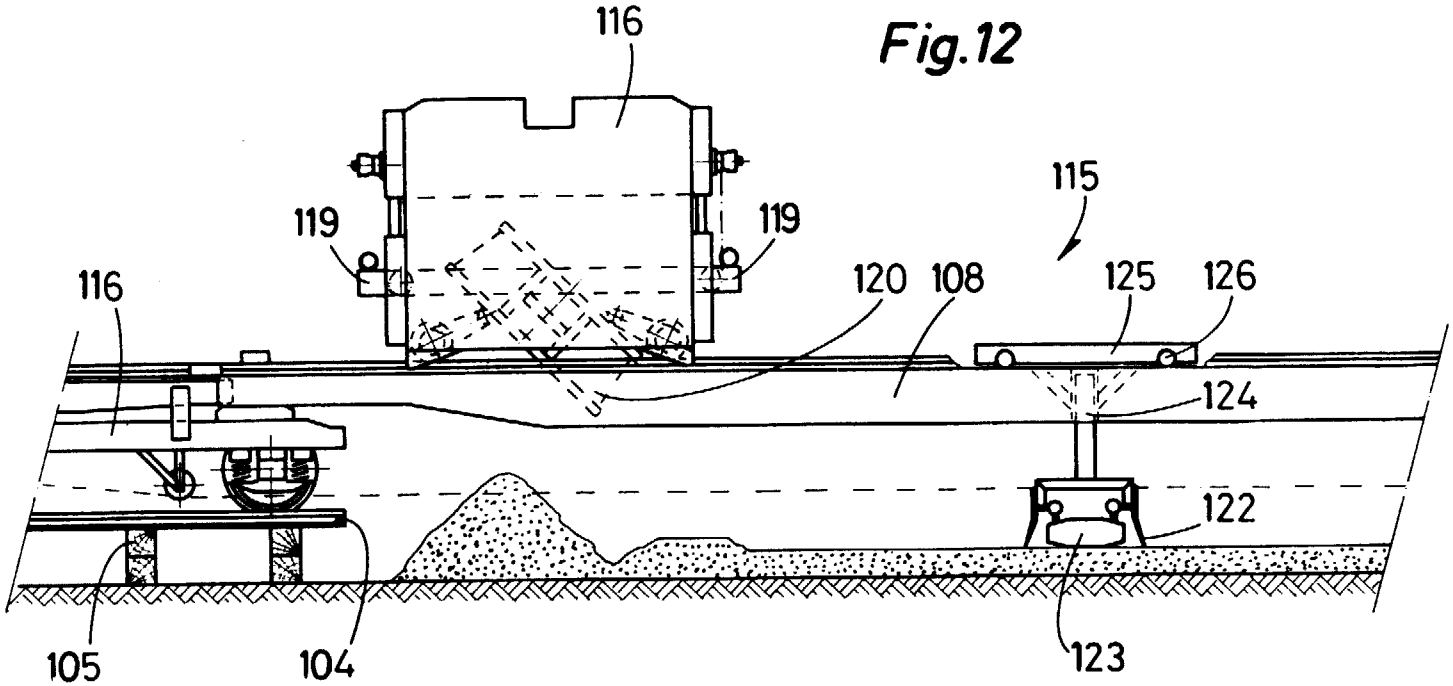
FIG. 12 shows the frame-car of the train and ancilliary equipment, to an enlarged scale with regard to FIG. 11.
Figure 13:
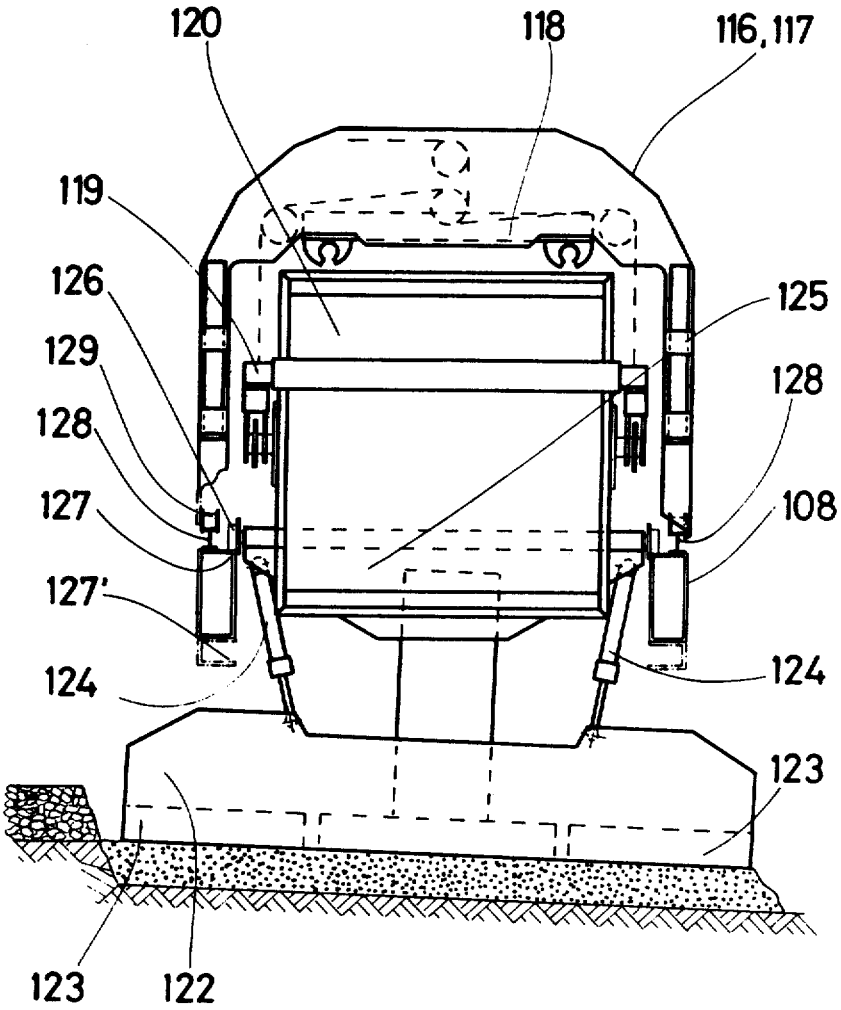
FIG. 13 is a cross section of the frame-car shown in FIG. 12 together with a gantry and a spreading-ramming chassis.

FIGS. 12 and 13 show ancilliary equipment for the working car 115. Provided on the sides of its empty frame 108 are tracks or guide rails 128 for the gantries extending to the cars 109 to 112 of the set of cars.

Two gantries 116 and 117 travel on this rails 128, which gantries are equipped both with a lifting device 118 for the spans 121 and a lifting and tipping device 119 for buckets 120. These gantries may thus convey full buckets over the entire length of the set of cars, over the top of the buckets in position on the cars, tip them in order to empty them through the empty frame 108 of the working car and return them to the cars carrying empty buckets.

FIG. 13 in particular shows the arrangement of the tracks 128 for the wheels 129 of gantries 116, 117. The wheels 126 of the levelling-ramming chassis 125 travel within the rails for the gantries, which allows the levelling-ramming chassis to move freely whilst passing below the gantries. The wheels 126 of the levelling-ramming chassis may travel either on the upper inner edge 127 of the frame 108, as shown in FIG. 13, or on a track 127' provided below the frame 108 and illustrated in dot dash line. The leveller-rammer is composed of levelling strips 122 and rammers 123. These two members cover the entire width of the roadbed. They are connected to the chassis 125 through the intermediary of jacks 124 which make it possible to regulate the working depth as well as the working inclination. The working inclination may be controlled automatically by means of a pendulum.

The gantries are propelled by their own motors. On the other hand, the levelling-ramming chassis will advantageously be moved to and fro along the length of the working car by means of a cable and a winch disposed on one of the ends of the working car, a return pulley being disposed at the other end of this car.

The work for improving drainage is carried out as follows:

by means of the working car 115, the gantries 116, 117 and two conveying cars 112 equipped with guide rails, the old spans are dismantled and the spans of working track 104 are assembled;

the excavator 103 and the set of discharge rail cars 101,102 are put in position;

the train is moved to a siding for unloading the cars laden with old spans and the set of rail cars for improving drainage is composed;

the old ballast is excavated with the excavator 103 and the excavated track is placed on supports;

the foundation is levelled with the blade 122 and then rammed;

the sand is supplied by the gantries and buckets which are emptied through the frame of the working car, then one proceeds with levelling and ramming of the sand;

the ballast is supplied, distributed and compacted and the spans are put in position;

to finish, the complementary ballast is unloaded between the sleepers and provisional packing is carried out.

As a variation of the working method described, the equipment of the set of rail cars 102 may also be used for laying long bars or rails previously unloaded at the sides of the track and for laying solely the sleepers.

In this variation, through the front part of the frame-car 115, the bed is levelled, after which sand and ballast are distributed, levelled and compacted. The sleepers are laid through the rear of the open frame of the frame-car 115 and at the same time the long bars or rails are placed on the sleepers as the train moves forward.

What is claimed is:

1. Train for improving the drainage of a railway track comprising a working car consisting of a frame-car with an empty frame of a length in excess of the length of one track span, said car having two trucks rolling the rear one on the new track and the front one on the old track and, ahead of said frame-car, a set of carriages provided with equipments for loading the excavation and, at the rear of said frame-car, other cars for transporting the spans, the sand and the ballast, guide rails installed on said transport cars and said frame-car, two gantries adapted to roll on said guide rails installed on said transport cars and said frame-car, said gantries supporting hoisting means for lifting a span and means for handling buckets for transporting the sand and ballast, and a rolling truck also movable on said guide rails ahead of said two gantries and from which at least one vertically adjustable excavator is suspended, said excavator covering either the full width of the excavation or only a reduced width, and being movable laterally or adapted to pivot for excavating the ballast, a swivel-mounted digging device mounted at the rear of said excavator, and comprising an endless chain associated with helical transverse fins, said digging device being provided with hydraulic cylinders for moving same in a vertical plane and in a longitudinal plane, respectively, said digging device being so designed that it can dig to a depth greater than the excavation and covers the full excavation width.

2. Train as claimed in claim 1, wherein said digging device is so designed that it can be utilized as a means for levelling the roadbed foundation, the sand and the ballast.

3. Train as claimed in claim 1 or 2, wherein said digging device consists of a blade made of several pivotally-mounted lateral sections each provided with hydraulic cylinders so that they can be moved separately or together in the vertical and longitudinal planes in the fashion of a power shovel bucket.

4. Train as claimed in claim 1 or 2, wherein said digging device is constructed like a grubbing rake adjustable in the longitudinal plane and for depth, said digging device further comprising a grading blade disposed above said grubbing rake and adjustable independently in depth so that the blade can also operate at the same level as the excavator.

5. Train as claimed in claim 4, wherein said grubbing rake and said grading blade consist each of several pivotally mounted sections, each section being controlled independently of, or in conjunction with, one another, by means of hydraulic cylinders.

6. Train as claimed in claim 1 or 2, wherein said digging device also acting as a leveller is adapted to be tilted along the track axis for obtaining the proper slant of roadbed foundation.

7. Train as claimed in claim 1 or 2, wherein said digging device is mounted to the excavator and so arranged as to cooperate with said excavator.

8. Train as claimed in claim 7, wherein a rammer for compacting the roadbed foundation, the sand and the ballast is mounted to said excavator behind said digging device, and is adjustable both vertically and for slant.

9. Train as claimed in claim 1 or 2, wherein said swivel-mounted digging device is mounted to an independent truck rolling on the guide rails of said frame-car, behind said excavator, and provided with independent traction means so that it can be moved independently of the excavator, said truck being preferably provided with a rammer.

10. Train as claimed in claim 1 or 2, wherein traction means are provided for moving said excavator and said truck respectively supporting said digging device, said traction means comprising a winch mounted on the front and rear cars.

11. Train as claimed in claim 1 or 2, wherein the rear end of said empty frame is mounted to the rear truck by means of a hydraulic cylinder so that the height of said empty frame can be adjusted to a position parallel to the roadbed foundation or the bench.

* * * * *